US006513805B2

(12) United States Patent
Takida et al.

(10) Patent No.: US 6,513,805 B2
(45) Date of Patent: Feb. 4, 2003

(54) AUTOMATIC DOCUMENT FEEDER AND IMAGE READER

(75) Inventors: Norio Takida, Shizuoka (JP); Takao Imamura, Tokyo (JP); Naoki Shoji, Kanagawa (JP); Seiji Iino, Kanagawa (JP); Eiji Fukasawa, Yamanashi (JP); Hiroshi Nakagomi, Yamanashi (JP); Jun Natori, Yamanashi (JP)

(73) Assignees: Nisca Corporation, Yamanashi (JP); Toshiba Tec Kabushiki Kaisha, Tokyo (JP)

( * ) Notice: Subject to any disclaimer, the term of this patent is extended or adjusted under 35 U.S.C. 154(b) by 44 days.

(21) Appl. No.: 09/814,100

(22) Filed: Mar. 22, 2001

(65) Prior Publication Data

US 2002/0008347 A1 Jan. 24, 2002

(30) Foreign Application Priority Data

Apr. 20, 2000 (JP) ..... 2000-119673

(51) Int. Cl.[7] ..... B65H 39/10; G03G 15/00
(52) U.S. Cl. ..... 271/291; 399/374
(58) Field of Search ..... 271/291; 399/374

(56) References Cited

U.S. PATENT DOCUMENTS 4,903,085 A * 2/1990 Ikeda et al. ..... 271/3.03
5,038,182 A * 8/1991 Tanimoto ..... 399/374
5,826,155 A * 10/1998 Kobayashi et al. ..... 358/496
6,393,251 B2 * 5/2002 Kono ..... 271/185

FOREIGN PATENT DOCUMENTS

JP 9-328263 * 12/1997 ..... B65H/85/00
JP 10-81449 3/1998

* cited by examiner

*Primary Examiner*—Donald P. Walsh
*Assistant Examiner*—Kenneth W Bower
(74) *Attorney, Agent, or Firm*—Armstrong, Westerman & Hattori, LLP

(57) ABSTRACT

The invention provides an image reader provided with an automatic document feeder which has a switchback path and can perform a both-faces processing operation, and which makes it possible to simplify the control of a switchback operation and handle a long-sized document sheet without making the diameter of a feed roller large and making the switchback path unnecessarily long. An automatic document feeder of the invention comprises a feed path for feeding a document sheet drawn out from a paper feed stacker to an image reading portion facing a feed roller, a switchback path c for making a document sheet which has been processed at the image reading portion switchback, a pair of switchback rollers which are provided so as to make a document sheet switchback in the switchback path and are able to turn forward and backward, and a paper discharge path for discharging a document sheet being in the switchback path onto a paper discharge stacker. Here, the switchback path c is provided in a casing below the paper discharge stacker and the casing has an opening formed in it so that the fore end of a document sheet guided into the switchback path projects from the casing. Further, the pair of switchback rollers are disposed at the downstream side in the switchback path so that the fore end and the rear end of a document made to switchback do not overlap each other through the feed roller.

9 Claims, 10 Drawing Sheets

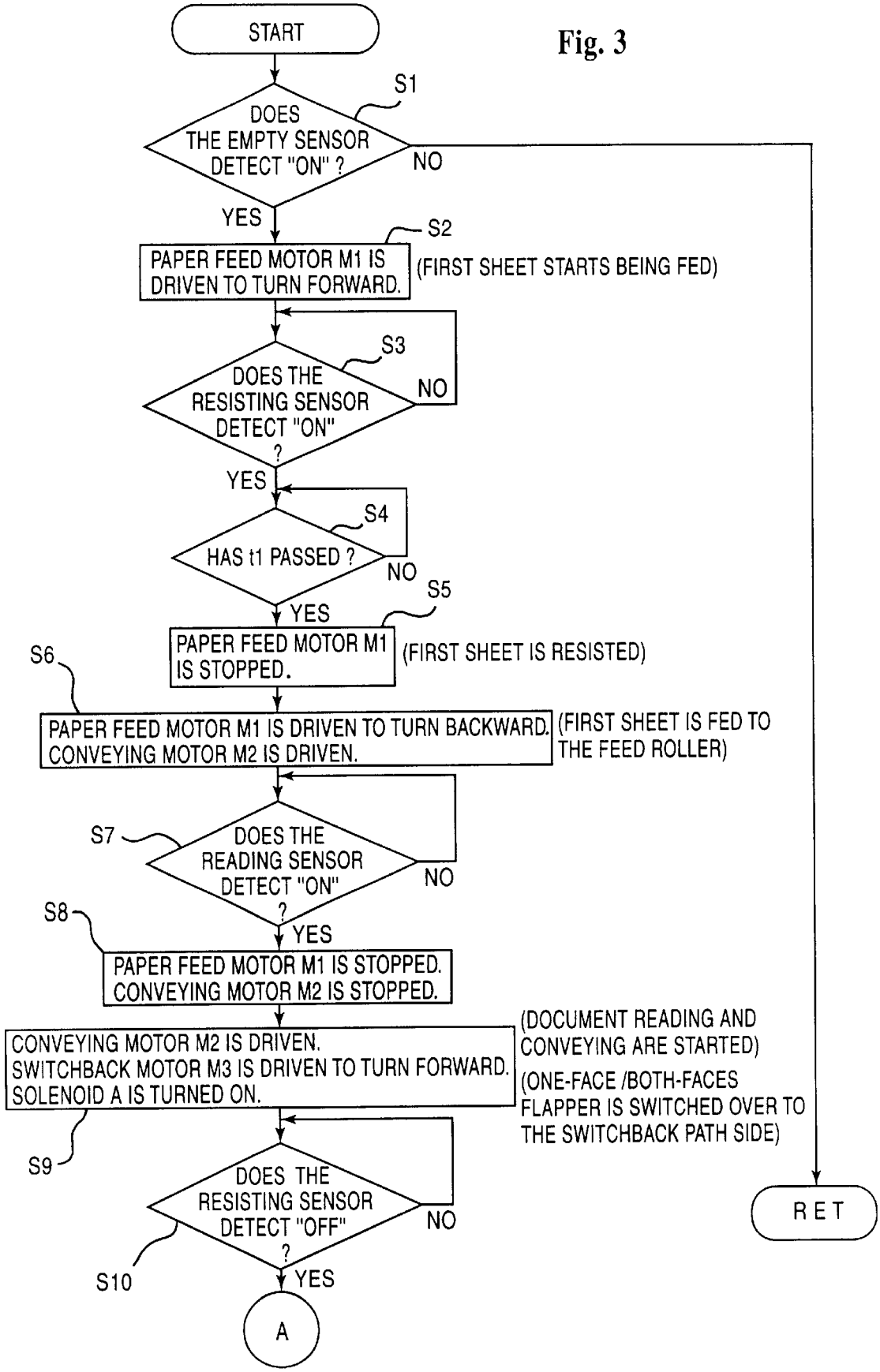
START
Fig. 3
S1
DOES THE EMPTY SENSOR DETECT "ON" ?
NO
YES
S2
PAPER FEED MOTOR M1 IS DRIVEN TO TURN FORWARD.
(FIRST SHEET STARTS BEING FED)
S3
DOES THE RESISTING SENSOR DETECT "ON" ?
NO
YES
S4
HAS t1 PASSED ?
NO
YES
S5
PAPER FEED MOTOR M1 IS STOPPED.
(FIRST SHEET IS RESISTED)
S6
PAPER FEED MOTOR M1 IS DRIVEN TO TURN BACKWARD.
CONVEYING MOTOR M2 IS DRIVEN.
(FIRST SHEET IS FED TO THE FEED ROLLER)
S7
DOES THE READING SENSOR DETECT "ON" ?
NO
YES
S8
PAPER FEED MOTOR M1 IS STOPPED.
CONVEYING MOTOR M2 IS STOPPED.
CONVEYING MOTOR M2 IS DRIVEN.
SWITCHBACK MOTOR M3 IS DRIVEN TO TURN FORWARD.
SOLENOID A IS TURNED ON.
(DOCUMENT READING AND CONVEYING ARE STARTED)
(ONE-FACE /BOTH-FACES FLAPPER IS SWITCHED OVER TO THE SWITCHBACK PATH SIDE)
S9
S10
DOES THE RESISTING SENSOR DETECT "OFF" ?
NO
YES
A
RET

AUTOMATIC DOCUMENT FEEDER AND IMAGE READER

BACKGROUND OF THE INVENTION

1. Field of the Invention

The present invention relates to an automatic document feeder for conveying consecutively document sheets to an information reading position of an image forming apparatus for forming an image on a document sheet such as an electrophotographic copying machine for example, and more particularly to an automatic document feeder being capable of efficiently performing a both-faces processing operation.

2. Prior Art

An image forming apparatus such as an electrophotographic copying machine and the like as described above uses a sheet conveying device called an automatic document feeder (ADF) so as to automatically draw out and feed one by one a plurality of document sheets to a position where the content of a document is read. Recently, such an automatic document feeder is composed so as to be able to process not only a document sheet having information recorded on one face of it but also a document sheet having information on both faces of it.

As such an automatic document feeder capable of performing both one-face processing and both-faces processing operations, for example Japanese Patent Laid-Open Publication No. Hei 10-81,449 has disclosed a composition making it possible to efficiently perform both one-face processing and both-faces processing operations.

According to this publicly known technique, in the one-face processing mode, document sheets each having information on its upside which are stacked in order on a paper feed stacker are drawn out one by one from the top, and each of them is turned over in a paper feed path and is scanned at an information reading position and then is discharged as it is. At this time, since document sheets to be discharged onto a paper discharge stacker are stacked in order as their information faces are kept looking down, finally the document sheets discharged do not need to be rearranged and therefore, efficient operations can be performed.

And in the both-faces processing mode, document sheets each having the odd-number page as its upside which are stacked in order on the paper feed stacker are drawn out one by one from the top, and each of them is turned over in the paper feed path and is scanned at the information reading position and then is guided to a switchback path provided at the downstream side of the information reading position. A pair of switchback rollers are arranged in the switchback path, and a document sheet turned back by this pair of switchback rollers is guided again to the paper feed path, is turned over here and the back face of it is scanned at the information reading position and then is guided to the switchback path as it is. And it is made to switchback and is discharged in a turned-over state.

At this time, since document sheets to be discharged onto the paper discharge stacker are stacked in order as their odd-number pages are kept looking down, finally the document sheets discharged do not need to be rearranged and therefore, efficient operations can be performed. And since the passage of a document sheet at the information reading position is limited to the irreducible minimum, the damage of a document sheet is reduced and the time for processing a document sheet is shortened and therefore document sheets can be consecutively and efficiently processed.

According to an automatic document feeder composed as described above, in case of processing the back face of a document sheet in the both-faces processing mode, a document sheet turned back from the switchback path is conveyed again into the switchback path after the back face of it has been processed. At this time, since the fore end and the rear end of a document may overlap each other at the position of the pair of switchback rollers, the pair of switchback rollers are arranged distantly from the feed roller so as not to hinder the conveyance of a document sheet.

In such a way, however, only by arranging the pair of switchback rollers distantly from the feed roller, the switchback path has to be made longer in consideration of processing a large-sized document sheet and thereby the apparatus results in being made large-sized as a whole.

Further, a conventional apparatus cannot handle a long-sized document sheet longer than a specified size since it is jammed in the switchback path.

The present invention has been performed in consideration of the problems in the switchback path of the above-mentioned prior art, and an object of the present invention is to provide an automatic document feeder which has a switchback path and can perform a both-faces processing operation, said automatic document feeder capable of simplifying the control of a switchback operation and making it possible to handle a long-sized document sheet without making large the diameter of a feed roller and without making the switchback path unnecessarily long, and thereby making it possible to process a more long-sized document sheet as keeping the automatic document feeder small-sized as a whole.

SUMMARY OF THE INVENTION

In order to solve the above-mentioned problems, the present invention provides an automatic document feeder comprising a feed path for feeding a document sheet drawn out from a paper feed stacker to an image reading portion facing a feed roller, a switchback path for making a document sheet which has been processed at the image reading portion switchback, a pair of switchback rollers which are provided so as to make a document sheet switchback in the switchback path and are able to turn forward and backward, and a paper discharge path for discharging a document sheet being in said switchback path onto a paper discharge stacker, wherein said switchback path is provided in a casing below said paper discharge stacker and said casing has an opening formed in it so that the fore end of a document sheet guided into the switchback path projects from the casing.

Hereupon, said casing is provided with a guide member for covering a document sheet projecting from said opening from the upper side and guiding it downward below said opening.

As described above, in an automatic document feeder according to the present invention, since the fore end of a document sheet projects from an opening of a casing, the automatic document feeder of the invention can be made small-sized as coping with the maximum size of document sheets to be handled.

In the present invention, differently from such a composition providing an opening in a switchback path, a curved portion may be formed in said switchback path so as to curve a document sheet guided into the switchback path in said switchback path. Due to this, it is possible to prevent a long-sized document sheet from being jammed in the switchback path.

Further, the present invention provides an image reader comprising a conveying means for drawing out one by one document sheets stacked on a paper feed stacker, conveying a document sheet to an image reading portion to optically read a document and discharging a read document sheet onto a paper discharge stacker, wherein said conveying means is composed of a feed means for feeding said document sheet to the image reading portion facing a feed roller, a switchback means for making a document sheet which has been read at the image reading portion switchback, a pair of switchback rollers which are provided so as to make a document sheet switchback in a switchback path and are able to turn forward and backward, and a paper discharge means for discharging a document sheet being in said switchback path onto a paper discharge stacker, wherein said pair of switchback rollers are disposed at a position in the switchback path where the fore end and the rear end of a document sheet being the largest in size to be handled do not overlap each other through said feed roller when said document sheet is made to switchback and is fed again to said feed roller.

Hereupon, the switchback path is provided in a casing below said paper discharge stacker, and an opening is formed in said casing so that the fore end of a document sheet guided into the switchback path projects from the casing, and said casing is provided with a guide member for covering a document sheet projecting from said opening from the upper side and guiding it downward below said opening, or said switchback path has a curved portion formed so as to curve a document sheet guided into the switchback path in said switchback path.

Furthermore, the present invention controls said pair of switchback rollers to turn slower when guiding a document sheet into the switchback path than when discharging the document sheet from the switchback path in order to make it possible to control more accurately the switchback position of a document sheet when making the document sheet switchback in the switchback path.

Due to this, the present invention has realized an automatic document feeder and an image reader being more small-sized in which when a both-faces reading process of a document sheet is performed the ends of a document sheet made to switchback between a switchback path and a feed roller do not overlap each other at the position of the pair of switchback rollers and a long-sized document sheet is not jammed in the switchback path.

BRIEF DESCRIPTION OF THE DRAWINGS

FIG. 3 shows a flowchart for explaining a process of controlling the conveyance of documents sheet in case of performing a both-faces processing operation in said automatic document feeder.

Figure 1:
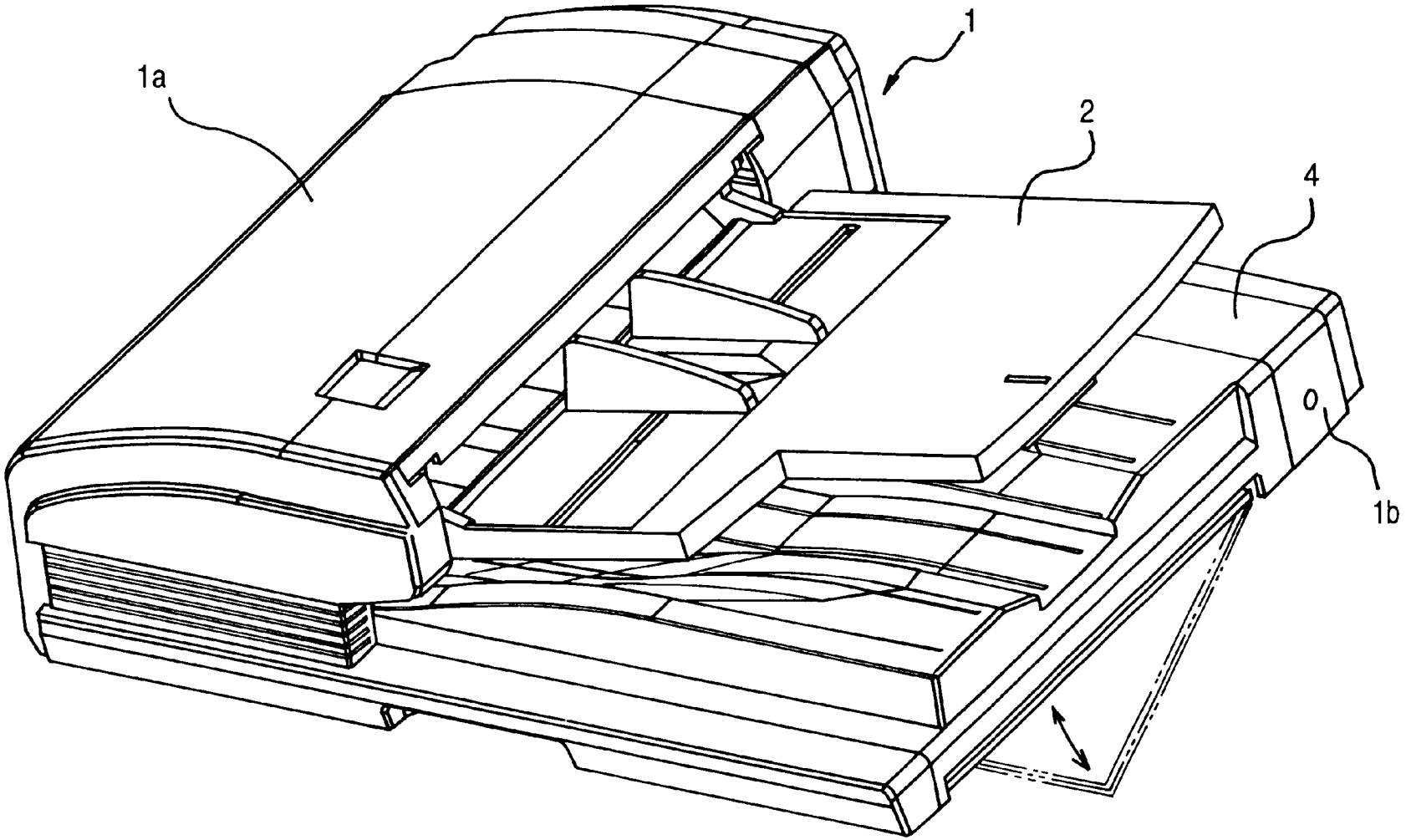
FIG. 1 is a perspective view showing a composition example of an automatic document feeder (ADF) according to the present invention.

2 Paper feed stacker
4 Paper discharge stacker
5 Feed roller
15 to 18 Contact rollers
20, 21 Switchover members
25 Pair of switchback rollers
27 Pair of paper discharge rollers
100 Electrophotographic copying machine
X Document reading position
1p Opening
aIntroduction path
bCircular path
cSwitchback pathdPaper discharge path

DESCRIPTION OF THE PREFERRED EMBODIMENTS OF THE INVENTION

An automatic document feeder according to the present invention is described in detail with reference to the drawings in the following. The following embodiments are described exemplifying an automatic document feeder (ADF) which is mounted on an electrophotographic copying machine being an image forming apparatus and feeds automatically and consecutively document sheets to a document reading position (image reading portion).

Figure 2:
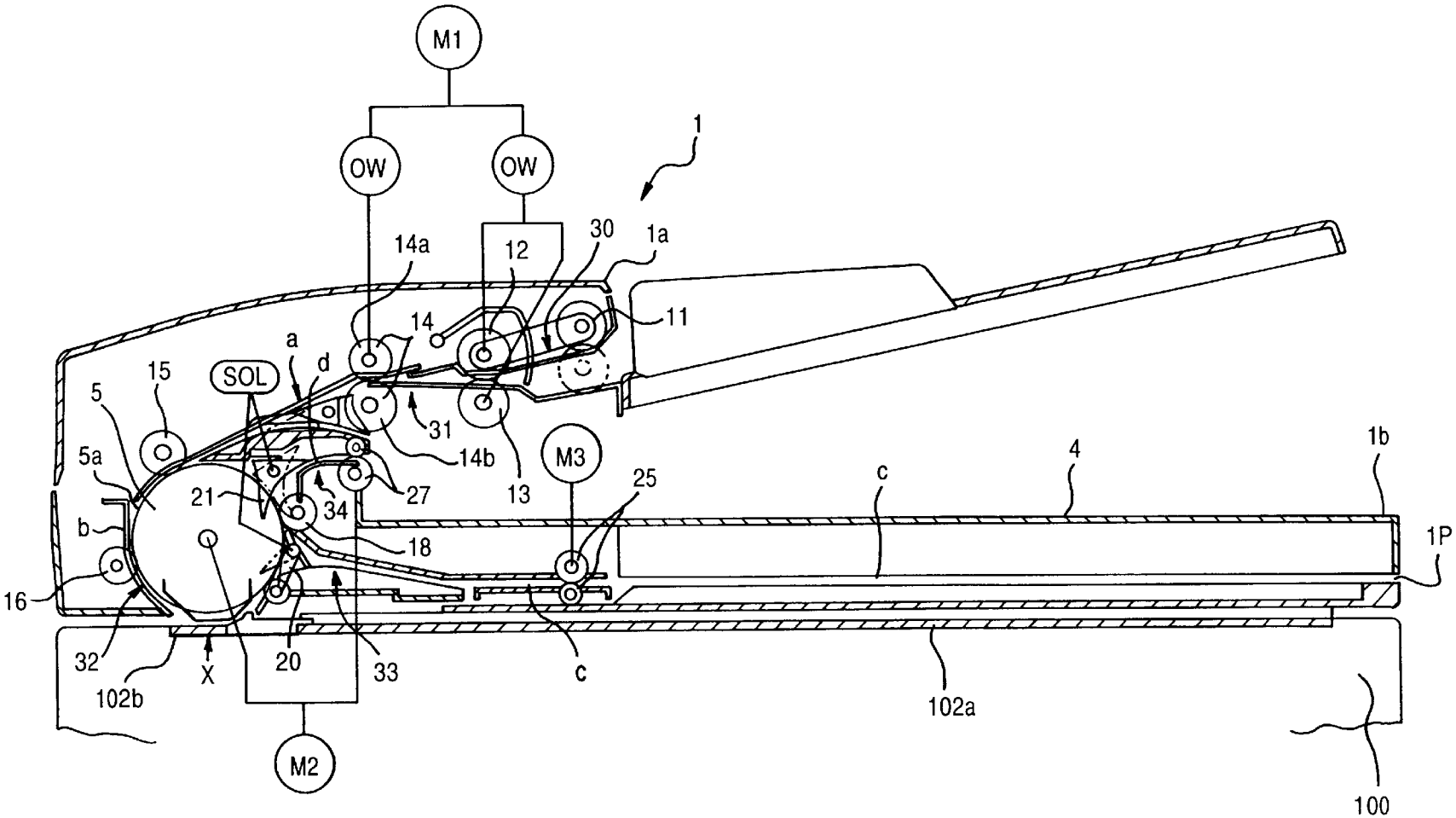
FIG. 2 shows the internal composition of the automatic document feeder shown in FIG. 1.
Figure 4:
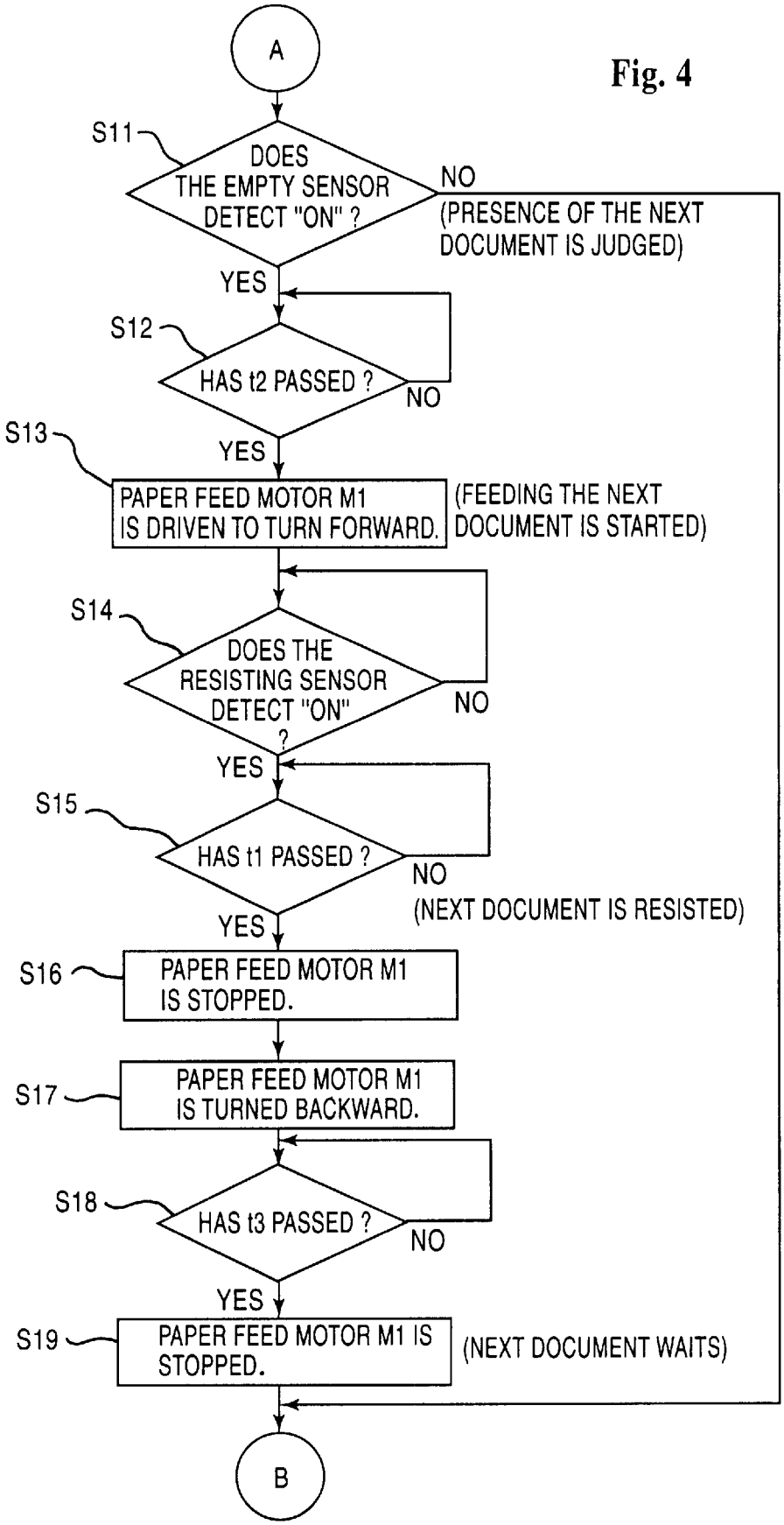
FIG. 4 shows a flowchart following the flowchart of FIG. 3.
Figure 5:
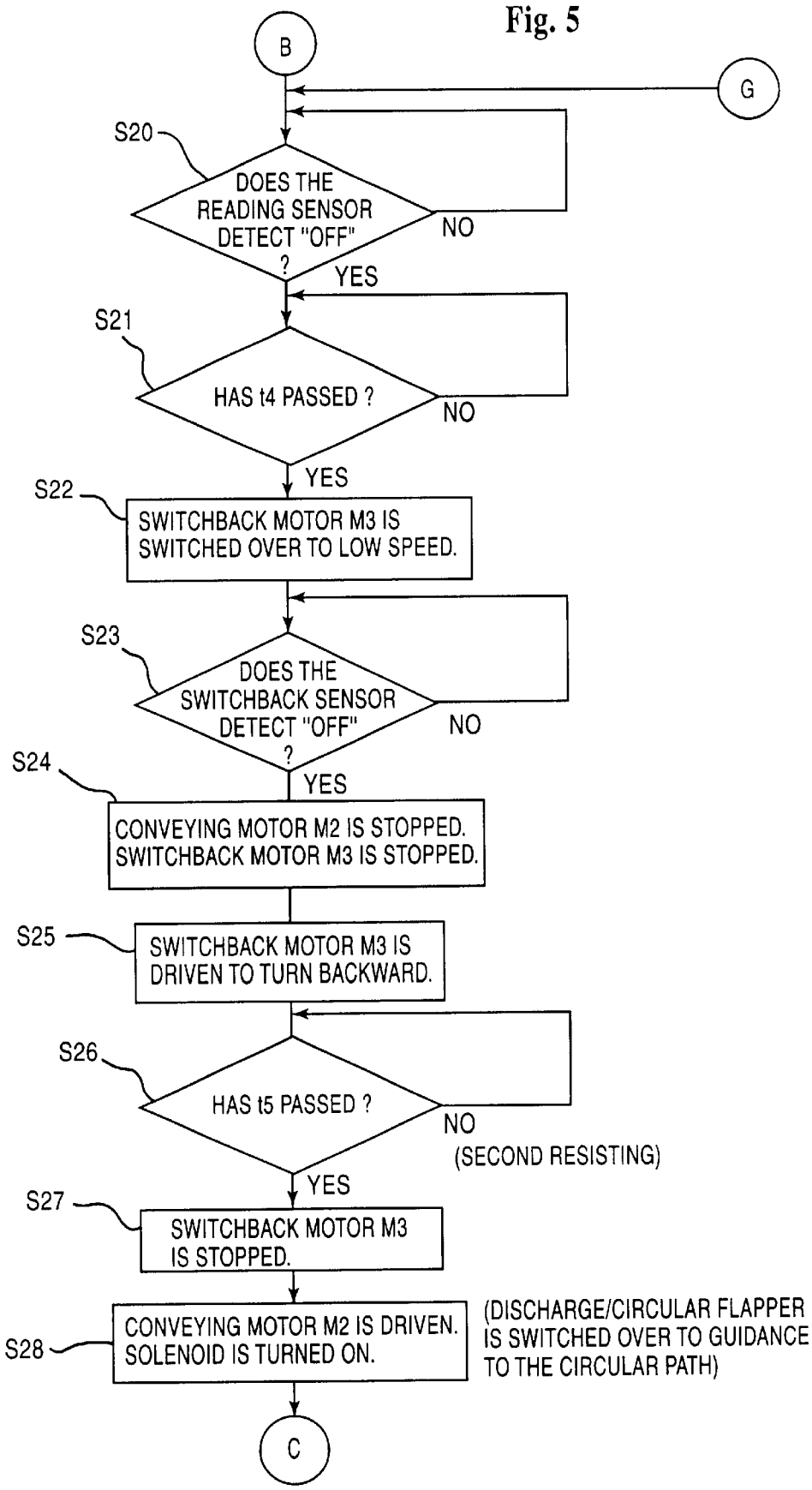
FIG. 5 shows a flowchart following the flowchart of FIG. 4.
Figure 6:
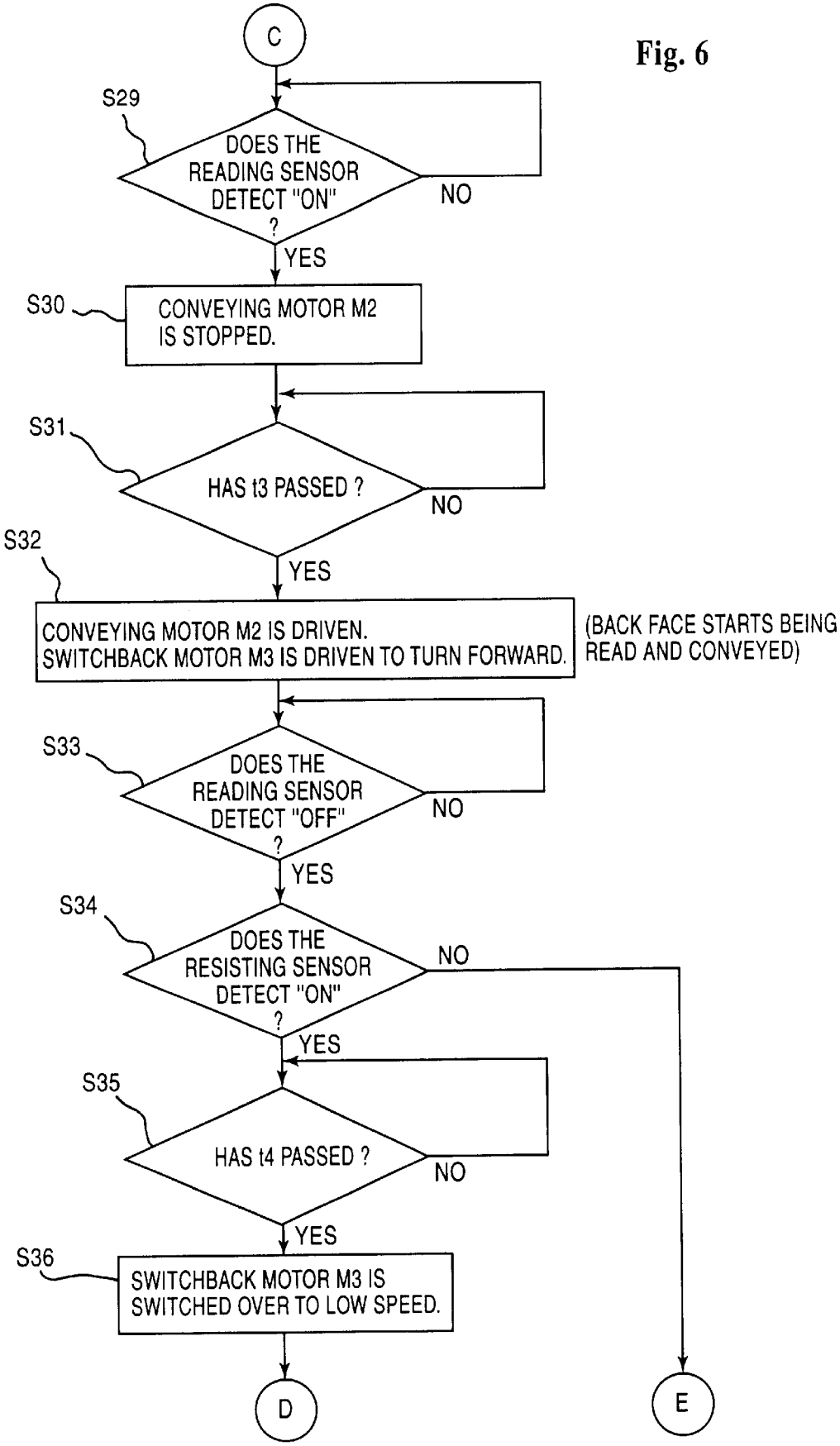
FIG. 6 shows a flowchart following the flowchart of FIG. 5.
Figure 7:
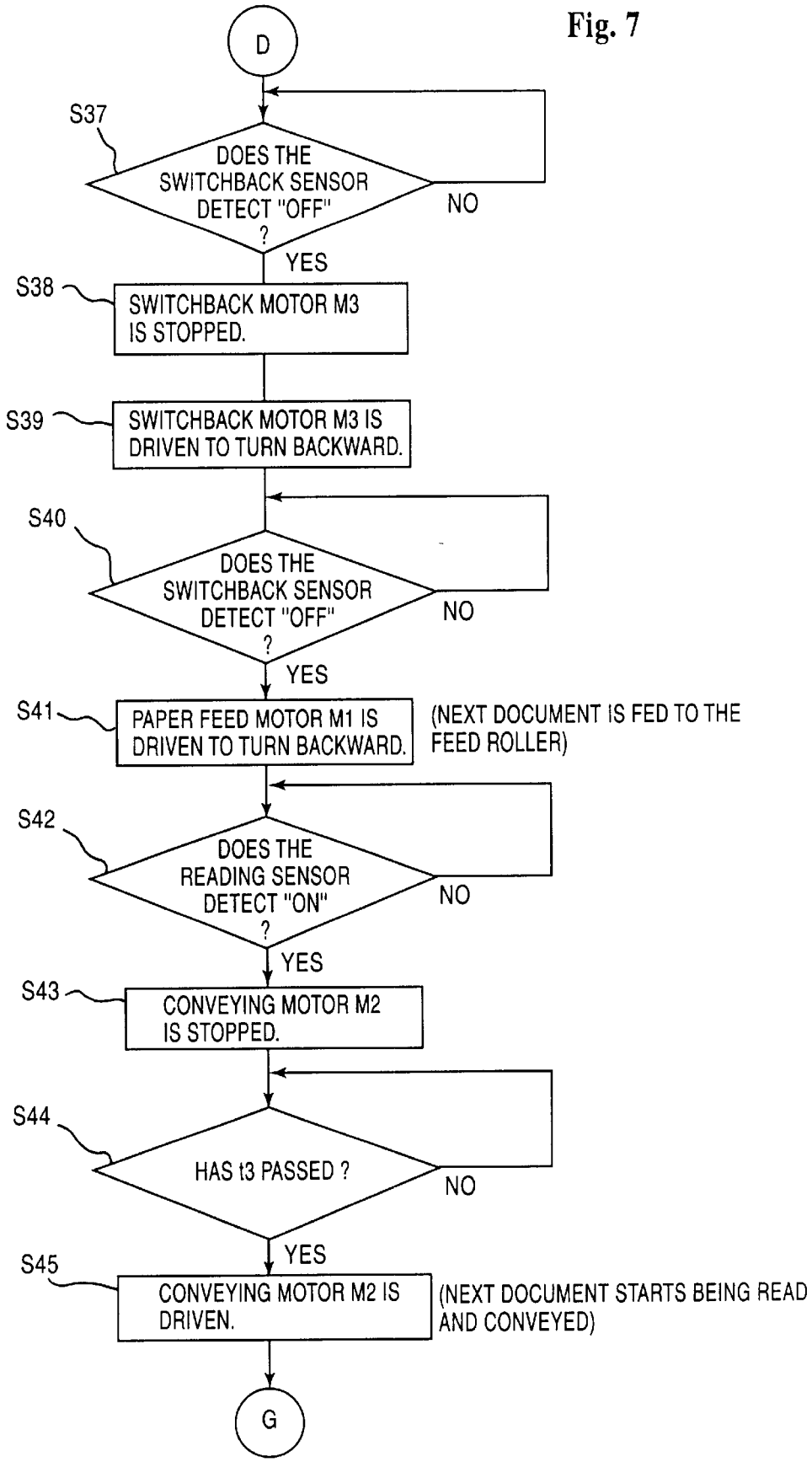
FIG. 7 shows a flowchart following the flowchart of FIG. 6.
Figure 8:
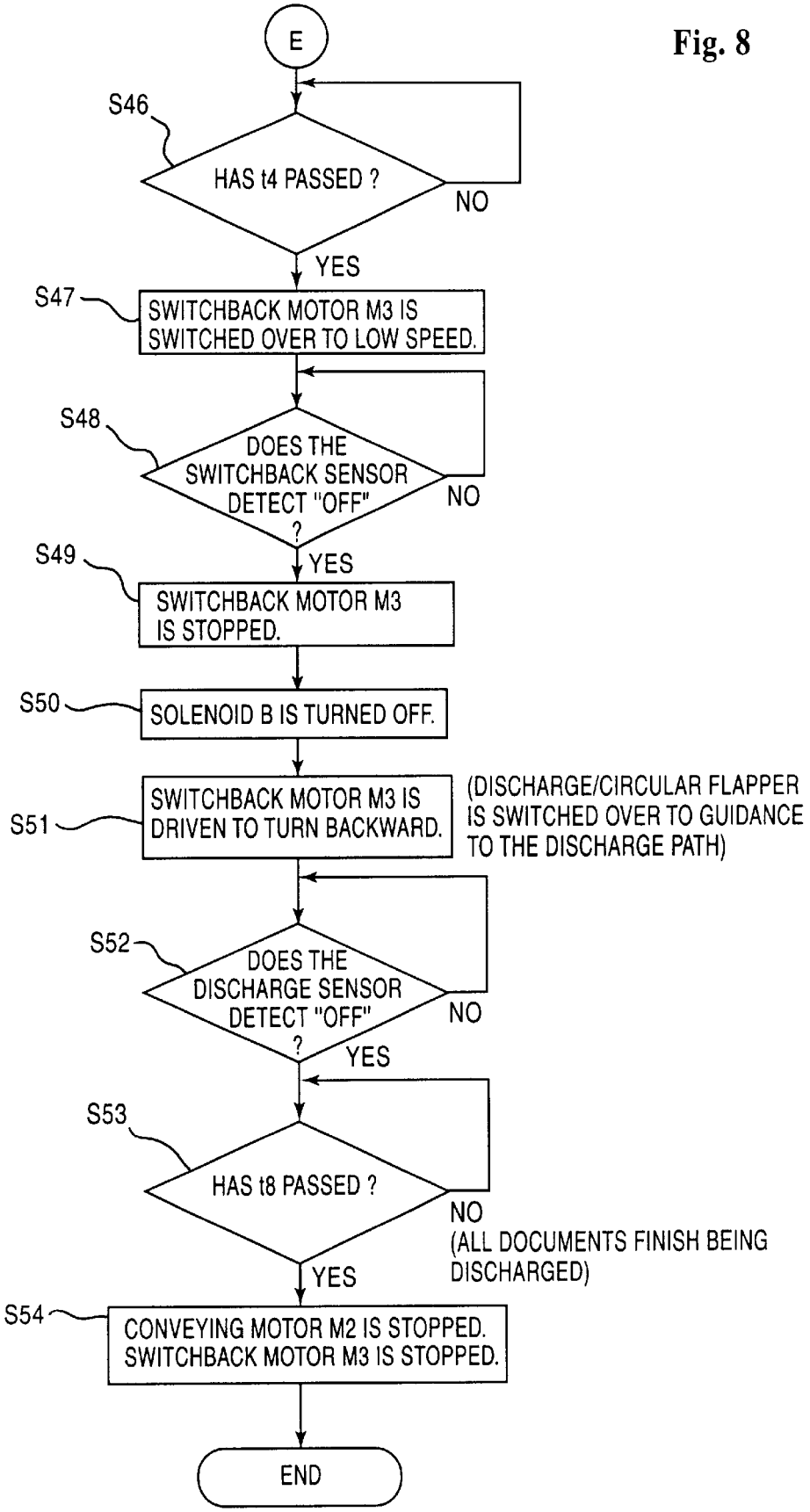
FIG. 8 shows a flowchart following the flowchart of FIG. 7.

FIG. 1 is a perspective view showing the appearance of an ADF to be mounted on an electrophotographic copying machine, and FIG. 2 shows the internal composition of it. In the upper part of the body of an electrophotographic copying machine 100, a document holding glass plate (first platen) 102*a* is arranged so as to make it possible to handle a document in the form of a book, and a cover glass plate (second platen) 102*b* over which document sheets conveyed consecutively by an ADF 1 pass is disposed at one side of the platen 102*a*.

A scanning means (not illustrated) for reading a document is arranged below said platens 102*a* and 102*b*, and in case of reading a document in the form of a book, as the scanning means a traveling body (not illustrated) to irradiate the document with light moves within a range of the first platen 102*a*, and in case of a consecutive process by the ADF 1, this scanning means is fixed at a position X below the second platen 102*b* (consecutively conveyed documents are read at this position). Such a scanning means as described above may be assembled into an electrophotographic copying machine 100 or may be assembled in advance as a unit into an ADF 1.

Said ADF 1 is composed so as to consecutively convey documents to a position X (called a reading position X) where a document is read. And the ADF 1 is provided with a pressing plate 1*a* to bring a document into close contact with the surface of said platen 102*a* so as to make it possible to process a document in the form of a book, and this pressing plate is provided on the bottom of a casing 1*b* extending from the main body 1*a* of the ADF 1.

The ADF 1 is disposed on said casing 1*b,* and is provided with a paper feed stacker 2 for having a plurality of document sheets stacked on it and a paper discharge stacker 4 onto which a document drawn out from this paper feed stacker 2 and finished in that its content is read at the reading position X is discharged. In this case, the paper discharge stacker 4 and the paper feed stacker 2 are provided at upper and lower positions relative to each other, and the upside of said casing 1*b* performs such a role. In this embodiment, document sheets each having its upside as a side to be processed are stacked on the paper feed stacker 2 in descending order of page from the bottom to the top and are drawn out one by one from the top.

Inside said main body 1*a,* there are arranged the respective guide paths for guiding a document sheet drawn out from the paper feed stacker 2. Concretely there are provided an introduction path a for introducing a document sheet drawn out from the paper feed stacker 2, a circular path b provided by the outer circumferential face of a large-diameter feed roller 5 arranged so as to face said image reading portion X, a switchback path c which is arranged so as to branch from the circular path b at the downstream side of the image reading portion X and which makes a document whose one face has been processed switchback and feeds it again to said circular path b in case of the both-faces processing mode, and a paper discharge path d which is arranged being curved so as to branch from the circular path b at the downstream side of the switchback path c and guides a document finished with its one-face process or both-faces process at the image reading portion X to said paper discharge stacker 4.

In the entrance of said introduction path a, there is arranged a drawing-out mechanism composed of a kick roller 11 for drawing out document sheets stacked on said paper feed stacker 2, and a feed roller 12 and a separating roller 13 for separating one by one the document sheets drawn out by the kick roller 11, and stacked document sheets are separated one by one in order from the top and drawn out to the introduction path a. And in the introduction path a there are a pair of conveying rollers composed of a driving roller 14*a* and a driven roller 14*b* so as to guide a document sheet separated into one sheet into said circular path b. Said feed roller 12 and said driving roller 14*a* are driven to turn only in one direction by a paper feed motor M1 capable of turning forward and backward through a one-way clutch for transferring only the rotational movement in one direction. By using such a composition, the present invention makes it possible to drive a conveying means by means of a single motor, make small the size of an automatic document feeder and reduce the cost of it.

Said circular path b is provided by the outer circumferential face 5*a* of the feed roller 5, and a first contact roller 15 and a second contact roller 16 being adjacent to each other are arranged so as to be in contact with the feed roller 5 in order from the upstream side in this path. And at the downstream side of the image reading portion X, a third contact roller 17 and a fourth contact roller 18 being adjacent to each other are arranged so as to be in contact with the feed roller 5 in order. Said switchback path c is arranged between the contact rollers 17 and 18, and the paper discharge path d is arranged at the downstream side of the contact roller 18. The feed roller 5 is driven by a conveying motor M2 to turn in the direction of conveying a document sheet (counterclockwise in the figure).

A first switchover member 20 driven to turn by an electromagnetic solenoid is arranged between said third contact roller 17 and said fourth contact roller 18. The first switchover member 20 is located so as to guide a document sheet conveyed along the circular path b from the image reading portion X to the paper discharge path d in the one-face processing mode, and is driven to turn so as to guide a document sheet conveyed along the circular path b from the image reading portion X to the switchback path c in the both-faces processing mode. This switchover member 20 is always pressed to a position shown in FIG. 2 by an energizing spring not illustrated, and is turned clockwise by exciting an electromagnetic solenoid and guides a document sheet from the circular path b to the switchback path c.

A second switchover member 21 driven to turn by said electromagnetic solenoid is disposed at the downstream side of said fourth contact roller 18. The second switchover member 21 is located so as to guide a document sheet conveyed along the circular path b from the image reading portion X to the paper discharge path d in the one-face processing mode, and is driven to turn so as to guide a document sheet conveyed along the circular path b from the switchback path c to the circular path as it is in the both-faces processing mode. This switchover member 21 is always pressed to a position shown in FIG. 2 by an energizing spring not illustrated, and is turned counterclockwise by exciting an electromagnetic solenoid and guides a document sheet from the switchback path c to the circular path b.

A pair of switchback rollers 25 driven by a motor M3 capable of turning forward and backward are arranged in said switchback path c. And a pair of paper discharge rollers 27 are arranged in said paper discharge path d, and are driven to turn only in the document sheet discharging direction by said driving motor M2.

An empty sensor 30 for detecting the presence of a document sheet is arranged on said paper feed stacker 2, and further a resisting sensor 31, a reading sensor 32, a switchback sensor 33 and a paper discharge sensor 34 are arranged respectively on this side of the pair of conveying rollers 14 of said introduction path a, on this side of the image reading portion X in said circular path b, at the entrance of said switchback path c and on this side of the pair of paper discharge rollers 27 in said paper discharge path d, and they detect the passage of a document sheet, respectively. These sensors 30 to 34 are connected to a CPU for controlling the driving of the whole apparatus, and said motors M1 to M3 arc driven and the solenoid is excited on the basis of the detection signals from the respective sensors.

In case of performing a both-faces processing operation in an ADF 1 composed as described above, a document sheet drawn out from the paper feed stacker 2 is guided to the switchback path c after one face of it has been read at the image reading portion X. And the document sheet guided to the switchback path c is conveyed in the inverse direction by the pair of switchback rollers 25 being driven to turn inversely at a specified point of time and is guided to the circular path c, and is guided again to the switchback path c after the other face of it has been read at the image reading portion X. And the document sheet guided again to the switchback path c is conveyed in the inverse direction by the pair of switchback rollers 25 being driven to turn inversely at a specified point of time and is guided to the paper discharge path d through the switchover member 21, and thereafter is discharged onto the paper discharge stacker 4 through the pair of paper discharge rollers 27. In this case, since document sheets discharged onto the paper discharge stacker 4 are made in the same state as the state of document sheets stacked on the paper feed stacker 2, the document sheets do not need to be rearranged.

Said switchback path c is provided inside said casing 1*b* as shown in FIG. 2 and is made so that the whole of a document sheet made to switchback is not exposed to the outside.

Hereupon, in the both-faces processing mode as described above, a state where the fore end and the rear end of a document sheet made to switchback in the switchback path c are overlap each other through the feed roller 5 (in a state where the document sheet is wound around the feed roller 5) occurs.

In the present invention, the pair of switchback rollers 25 are disposed at the downstream side in the switchback path c, and therefore the ends of a document sheet do not overlap each other at the position of the pair of switchback rollers 25. Concretely, the pair of switchback rollers 25 are disposed at the more downstream side than a position where the fore end and the rear end of a document sheet having the maximum size capable of being processed by the ADF 1 (for example, size A3 in Japanese Industrial Standard) overlap each other through the feed roller 5.

Such a composition makes it unnecessary to detach the pair of switchback rollers 25 from each other at the time of the switchback operation, and its control is simplified and the cost can be reduced. In order to prevent the ends of a document sheet from overlapping each other at the position of the pair of switchback rollers 25, the diameter of the feed roller 5 may be made larger, but since the whole apparatus is made large-sized when it is made too large, the diameter of the feed roller is determined according to the maximum size of a document capable of being processed by this document feeder.

And according to said composition, since the pair of switchback rollers 25 are disposed at the downstream side in the switchback path c, a document sheet guided to the switchback path also is necessarily shifted to the downstream side. Due to this, the casing 1*b* of this embodiment has an opening 1*p* formed at a position corresponding to the switchback path c and the fore end of a document sheet guided into the switchback path c is made to project from the casing 1*b*. By forming such an opening, the casing 1*b* does not need to be made large-sized in the document conveying direction and the whole apparatus can be made small-sized.

In said composition, it is preferable that said motor M3 for driving the pair of switchback rollers 25 is controlled so that the rotational speed of the pair of switchback rollers 25 when guiding a document sheet into the switchback path c is slower than the rotational speed when discharging the document sheet from the switchback path c. Ordinarily, if the rotational speed of a motor is too fast, when stopping the rear end of a document sheet on this side of the pair of switchback rollers 25 after the switchback sensor 33 detects the rear end of the document sheet, the stop position of it is liable to vary. However, by controlling the pair of switchback rollers to become slower in rotational speed as described above, it is possible to exactly control and stabilize the stop position of a document sheet. As the result, due to stabilizing the stop position of a document sheet, to avoid making the casing 1*b* unnecessarily large-sized in the document conveying direction contributes to making the whole apparatus small-sized.

And since the length of projection of a document sheet from the opening 1*p* can be reduced to the minimum, a user of this apparatus does not feel strange.

Next, a process of controlling the conveyance of document sheets in case of performing a both-faces processing operation by means of an ADF 1 composed as described above is concretely explained according to FIG. 2 and flowcharts shown in FIGS. 3 to 8.

When the empty sensor 30 detects the on state, namely, detects that document sheets are stacked on the stacker 2, the paper feed motor M1 is driven to turn forward and the first document sheet is fed (S1 and S2). At this time, the kick roller 11 and the feed roller 12 are driven to turn in the document feed direction, but the driving roller 14*a* of the pair of conveying rollers 14 is not turned due to the action of a one-way clutch. And when the resisting sensor 31 detects the fed document sheet, the paper feed motor M1 is stopped temporarily a specified time after this detection (S3 to S5). When the paper feed motor M1 is stopped, the fore end of the document sheet strikes the nipping part of the pair of conveying rollers 14 and the document sheet is bent and thereby the skew of it is removed. And after this temporary stop the paper feed motor M1 is driven to turn backward and the conveying motor M2 is driven (S6). At this time the kick roller 11 and the feed roller 12 are not turned due to the action of the one-way clutch, but the driving roller 14*a* of the conveying rollers 14 is driven to turn in the document feed direction.

The document sheet is conveyed from the introduction path a into the circular path b by the rotational driving of said motors M1 and M2, and when the reading sensor 32 detects the passage of the document sheet, the paper feed motor M1 is stopped and the conveying motor M2 is temporarily stopped (S7 and S8). And when the conveying motor M2 is driven again, the surface of the document is vertically scanned and read by said scanning means (S9). And when the reading sensor 32 detects the passage of the fore end of the document, the switchback motor M3 is driven to turn forward and the solenoid is excited, and the document sheet read at the image reading portion X is guided into the switchback path c through the switchover member 20.

After the first document sheet is fed, when the resisting sensor 31 detects the passage of the rear end of this document sheet, a specified time t2 after the detection the operation of drawing out the next document sheet is started in case that there are further document sheets on the stacker 2 (S10 to S13). When the next document sheet is drawn out, the skew of the document is removed in the same process in case of the preceding document (S14 to 17). And a specified time t3 after the paper feed motor M1 is driven to turn backward, the driving of the paper feed motor M1 is stopped and thereby the feed operation by the pair of conveying rollers 14 is stopped (S18 and S19). At this time the fore end of the next document sheet is stopped on this side of the contact roller 15 and is in a waiting state.

On the other hand, the preceding document guided to the switchback path c is conveyed by the forward turning of the pair of switchback rollers 25 (S9) as directing the fore end of it to the switchback path c in the casing 1*b*. In this state of conveyance, a specified time t4 after the reading sensor 32 detects the passage of the rear end of the document, the driving of the switchback motor M3 is switched over to the low speed (S20 to S22). And when the switchback sensor 33 detects the rear end of the document in this state of conveyance, the conveying motor M2 and the switchback motor M3 are stopped to turn forward and the switchback motor M3 is driven to turn backward (S23 to S25). In conveying the document sheet to the switchback path c, since the rotational speed of the pair of switchback rollers is controlled to be slower, the stop position of the document sheet is stabilized, and in a state where the document sheet is at a stop, the fore end of the document sheet in the feed direction projects from the opening 1*p*.

The switchback motor M3 drives the pair of switchback rollers 25 to turn backward by its backward rotation and the document sheet is turned back. In this case, after a specified time t5 has elapsed the turning-back motor M3 is stopped so that the skew of the document is removed by flexibly bending the fore end portion of the document at the nipping part of the feed roller 5 and the fourth contact roller 18 (S26 and S27).

And when this specified time t5 has elapsed; the conveying motor M2 is driven to turn (S28) and due to this the preceding document is conveyed along the circular path (the switchover member 21 keeps the circular path b open due to a state where the solenoid is excited).

And when the fore end of the document being turned back along the circular path b is detected by the reading sensor 32, the conveying motor M2 is kept at a stop for a specified time t3 and thereafter the conveying motor M2 is driven again and thereby the back of the document is vertically scanned and read by said scanning means (S29 to S32).

And a specified time t4 after the reading sensor 32 detects the rear end of the preceding document whose back is read, the driving of the switchback motor M3 is switched over to the low speed (S33, S35 and S36). And when the switchback sensor 33 detects the rear end of the document in this state of conveyance, after the forward driving of the switchback motor M3 is stopped, the switchback motor M3 is driven to turn backward and the solenoid is turned off to open the paper discharge path d side (S37 to S39). Since the pair of switchback rollers 25 are controlled to turn slowly in the same way as described above when a document sheet is conveyed into the switchback path c, the stop position of the document is stabilized and the fore end in the feeding direction of the document sheet being at a stop is projected from the opening 1*p*.

By the backward driving of the switchback motor M3, the pair of switchback rollers 25 are driven to turn backward and the document is turned back. In this case, the document sheet is guided to the paper discharge path d through the switchover member 21 and is discharged, and the switchback sensor 33 detects the rear end of the document sheet turned back (discharged) (S40) and thereby the paper feed motor M1 is driven to turn backward (S41) to start feeding the next document being in said waiting state.

And when the fore end of the next document sheet is detected by the reading sensor 32 the conveying motor M2 is kept at a stop for a specified time t3 and thereafter the conveying motor M2 is driven again and thereby the surface of the next document sheet is scanned and read by said scanning means (S42 to S45). And the next document receives a both-faces reading operation according to said procedure of S20 to S39 and is discharged onto the paper discharge stacker 4, and the document sheets following this also receive a both-faces reading operation in order according to the same procedure, and then are discharged onto the paper discharge stacker 4.

By the way, in case of consecutively processing document sheets, when no presence of a document sheet is detected by the resisting sensor 31 (S34) while the back of a document sheet is being read (S32), the document sheet being under processing is made the last document sheet.

In this case, the document whose: back is being processed is guided to the switchback path c and the fore end of it is conveyed by the pair of switchback rollers 25 toward the switchback path c in the casing 1*b*. In this state of conveyance, a specified time t4 after the reading sensor 32 detects the passage of the rear end of the document sheet, the driving of the switchback motor M3 is switched over to the low speed (S33, S34, S46 and S47). And when the switchback sensor 33 detects the rear end of the document in this state of conveyance, the forward driving of the switchback motor M3 is stopped and the solenoid is turned off to open the paper discharge path d, and the switchback motor M3 is driven to turn backward (S48 to S51). Since the pair of switchback rollers 25 are controlled to turn slowly also when the document sheet is conveyed into the switchback path, the stop position of the document sheet is stabilized, and the fore end in the feeding direction of the document sheet is projected from the opening 1*p*.

The pair of switchback rollers 25 are driven to turn backward by the backward driving of the switchback motor M3 and the document sheet is turned back and guided to the paper discharge path d. And a specified time t8 after the discharge sensor 34 detects the rear end of the document sheet, the conveying motor M2 and the switchback motor M3 are stopped (S52 to S54), and all the document sheets stacked on the paper feed stacker 2 finish being processed.

As described above, according to an ADF of this embodiment, since the pair of switchback rollers 25 are arranged at the more downstream side than a position where the fore end and the rear end of a document in a switchback operation overlap each other, the pair of switchback rollers 25 do not need to be detached from each other in a switchback operation and therefore the control is simplified.

And in addition to such a composition, since the opening 1*p* is formed in the casing 1*b* and the fore end of a document sheet guided into the switchback path is made to project from it, the casing is made small-sized in the document conveying direction and the apparatus can be small-sized as a whole. Further, since in conveyance of a document sheet to the switchback path the pair of switchback rollers 25 are driven to turn slowly and thereby the stop position of the document sheet just before the pair of switchback rollers 25 is stabilized, the casing is prevented from being made large-sized in the document conveying direction due to variation in the stop positions.

Said embodiment makes the fore end of a document sheet guided into the switchback path project to the outside in order to make the casing small-sized, but when a document sheet is exposed to the outside in an actual operation, it is conceivable that such a trouble as paper jamming or the like is caused by touching the document sheet by mistake.

Thereupon, by composing as below, it is possible to prevent a document sheet from being exposed and make the casing small-sized.

Figure 9:
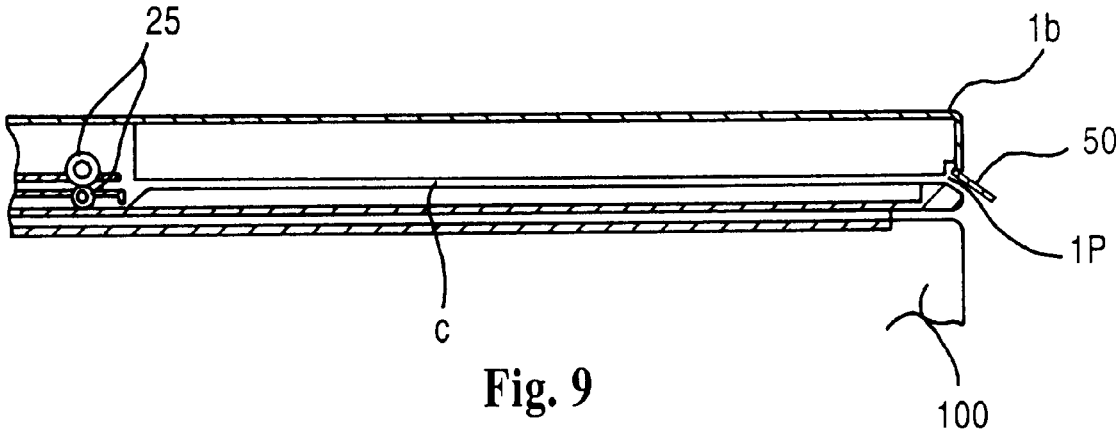
FIG. 9 shows a first variation example of an automatic document feeder according to the present invention.

A variation example shown in FIG. 9 guides downward a document sheet exposed from an opening 1*p* by attaching a guide 50 of Mylar or the like to the casing 1*b* in the above-mentioned embodiment. This composition prevents an exposed document from being touched by hand.

Figure 10:
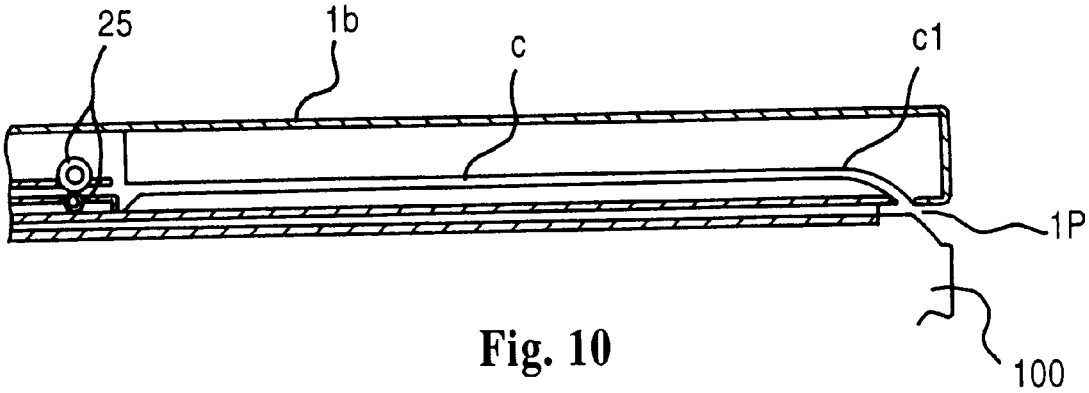
FIG. 10 shows a second variation example of an automatic document feeder according to the present invention.
Figure 11:
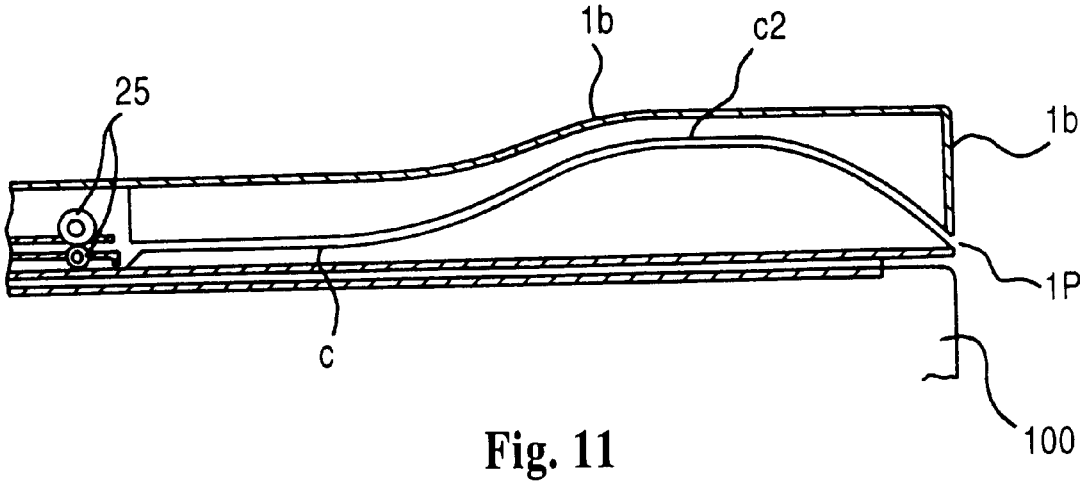
FIG. 11 shows a third variation example of an automatic document feeder according to the present invention.
Figure 12:
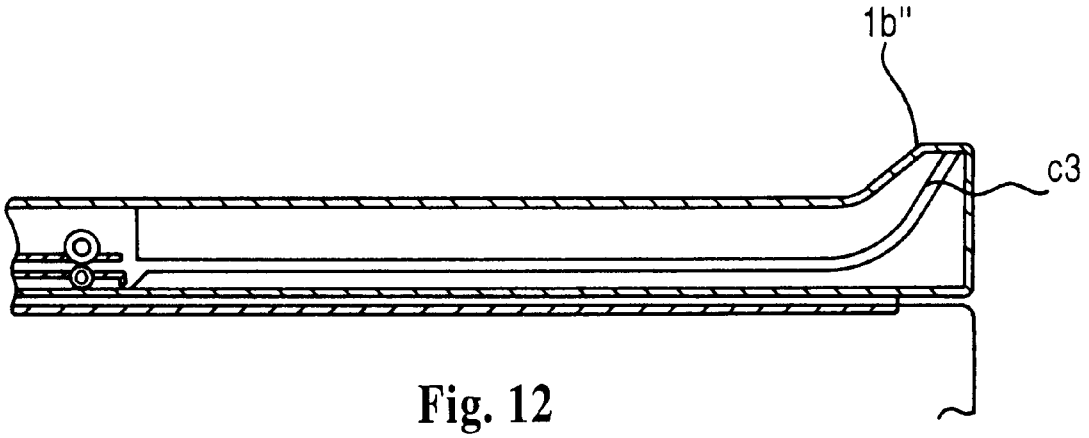
FIG. 12 shows a fourth variation example of an automatic document feeder according to the present invention.

Variation examples shown in FIGS. 10 to 12 are provided with curved portions c1, c2 and c3 for guiding curvedly a document at the fore end side of the switchback path c or from the middle part to the fore end side of the switchback path c. According to such compositions, a document sheet made to switchback can be curved and thereby the casing 1*b* can be efficiently made small-sized. In this case, a thick part 1*b*′ or 1*b*″ may be formed in the casing 1*b* according to the shape of a curved portion to be formed. And like the above-mentioned compositions, an opening for projecting the fore end of a document sheet may be formed, or in addition to this a guide of Mylar or the like may be attached.

The above mentioned embodiments have been described as examples usually handling a large-sized document sheet up to size A3 in Japanese Industrial Standard (JIS). Thereupon, a variation example for handling a long-sized document sheet longer than size A3 in JIS as a large-sized document sheet is described with reference to FIG. 13.

Figure 13:
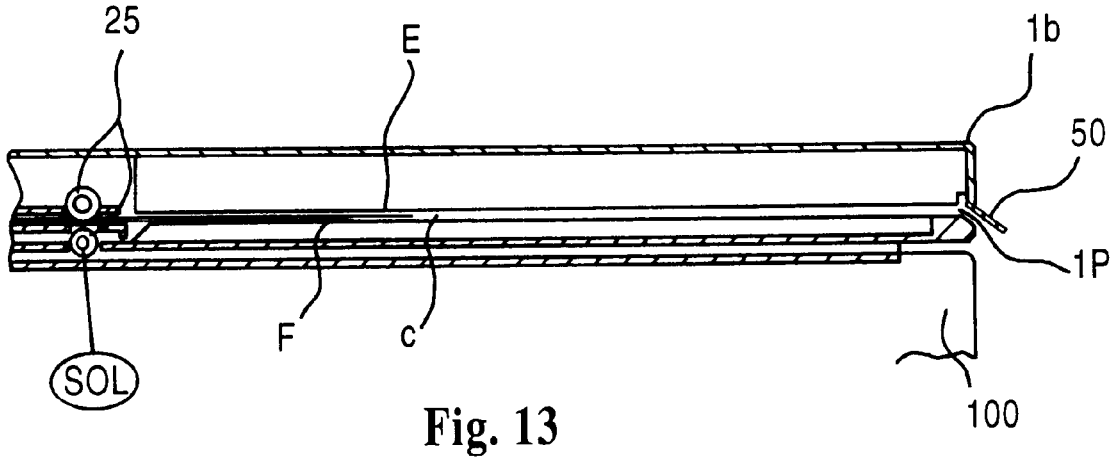
FIG. 13 shows a fifth variation example of an automatic document feeder according to the present invention. (Description of the Symbols) 1 Automatic document feeder (ADF)

As shown in FIG. 13, one roller out of a pair of switchback rollers 25 is provided with a solenoid for detaching the pair of switchback rollers 25 from each other, and is controlled so that the pair of switchback rollers 25 are detached from and brought into contact with each other at specified points of time.

That is to say, a document sheet one face of which has been read at the image reading portion X and which has been conveyed to the switchback path c is made to switchback and fed again to the image reading portion X. In this case, when the fore end of the document sheet is detected by the reading sensor 32, the solenoid is turned on to detach the pair of switchback rollers 25 from each other.

And the fore end F of the document sheet passes the image reading portion X, is conveyed again to the switchback path c and the fore end F and the rear end E of the document sheet pass each other in the switchback path c. Since at this time the pair of switchback rollers 25 are kept apart from each other as shown in FIG. 13, the document sheet is conveyed without hindrance and the fore end of the document sheet is projected from the opening 1*p* to the outside. After this, when the rear end of the document sheet is detected by the reading sensor 32, the solenoid is turned off and the pair of switchback rollers 25 are brought into contact with each other. And a document sheet whose two faces have been read is made to switchback in the switchback path c, is guide to the paper discharge path d and is stacked on the paper discharge stacker 4.

This variation example also has the same composition as the embodiments already described above and is controlled in the same way as them except the composition and control for detaching the pair of switchback rollers 25 from each other. By forming an opening for projecting the fore end F of a document to the outside in the switchback path c and by detaching the pair of switchback rollers 25 from each other, it is possible to convey a long-sized document sheet without hindrance even in case that said long-sized document sheet is longer than a document ordinarily handled and read both faces of said document sheet.

An automatic document feeder of the present invention has been described above taking an ADF to be mounted on a copying machine as an example, but an automatic document feeder as described above may be composed so as to be mounted on a printer or the like for printing on a document sheet.

As described above, the present invention is characterized by the composition of a switchback portion for making a document sheet switchback, and can properly change the other compositions, for example, the positions of arrangement of the respective sensors, the conveying paths of a document sheet, the number of solenoids or motors, the points of time of driving, and the like.

According to the present invention, in an automatic document feeder which has a switchback path and can perform a both-faces processing operation, it has been made possible to simplify the control of a switchback operation and handle a long-sized document sheet without making the diameter of a feed roller large and making the switchback path unnecessarily long. Further, due to this the present invention has made it possible to process a longer document sheet as keeping the apparatus small-sized as a whole.

What is claimed is:

1. An automatic document feeder comprising;

a feed path for feeding a document sheet drawn out from a paper feed stacker to an image reading portion facing a feed roller, a switchback path for making a document sheet which has been processed at the image reading portion switchback, a pair of switchback rollers which are provided so as to make a document sheet switchback in the switchback path and are able to turn forward and backward, and a paper discharge path for discharging a document sheet being in said switchback path onto a paper discharge stacker, wherein;

said switchback path is provided in a casing below said paper discharge stacker and said casing has an opening formed in it so that the fore end of a document sheet guided into the switchback path projects from the casing.

2. An automatic document feeder according to claim 1, wherein;

said casing is provided with a guide member for covering a document sheet projecting from said opening from the upper side and guiding it downward below said opening.

3. An automatic document feeder comprising;

a feed path for a document sheet drawn out from a paper feed stacker to an image reading portion facing a feed roller, a switchback path for making a document sheet which has been processed at the image reading portion switchback, a pair of switchback rollers which are provided so as to make a document sheet switchback in the switchback path and are able to turn forward and backward, and a paper discharge path for discharging a document sheet being in said switchback path onto a paper discharge stacker, wherein;

said switchback path has a curved portion formed in it so as to curve a document sheet guided into the switchback path in said switchback path.

4. An automatic document feeder according to one of claims 1 to 3, wherein;

said pair of switchback rollers are controlled to turn slower when guiding a document sheet into the switchback path than when discharging a document sheet from the switchback path.

5. An image reader comprising a conveying means for drawing out one by one document sheets stacked on a paper feed stacker, conveying a document sheet to an image reading portion to optically read a document and discharging a read document sheet onto a paper discharge stacker, wherein;

said conveying means is composed of a feed means for feeding said document sheet to the image reading portion facing a feed roller, a switchback means for making a document sheet which has been read at the image reading portion switchback, a pair of switchback rollers which are provided so as to make a document sheet switchback in a switchback path and are able to turn forward and backward, and a paper discharge means for discharging a document sheet being in said switchback path onto a paper discharge stacker, and said pair of switchback rollers are disposed at a position in the switchback path at which position the fore end and the rear end of a document being the largest in size to be handled do not overlap each other through said feed roller when said document sheet is made to switchback and fed again to said feed roller.

6. An image reader according to claim 5, wherein;

said switchback path is provided in a casing below said paper discharge stacker, and said casing has an opening formed in it so that the fore end of a document sheet guided into the switchback path projects from the casing.

7. An image reader according to claim 6, wherein;

said casing is provided with a guide member for covering a document sheet projecting from said opening from the upper side and guiding it downward below said opening.

8. An image reader according to claim 5, wherein;

said switchback path has a curved portion formed in it so as to curve a document sheet guided into the switchback path in said switchback path.

9. An image reader according to one of claims 5 to 8, wherein;

said pair of switchback rollers are controlled so as to turn slower when guiding a document sheet into the switchback path than when discharging the document sheet from the switchback path.

* * * * *